United States Patent [19]

Justus et al.

[11] Patent Number: 4,476,637

[45] Date of Patent: Oct. 16, 1984

[54] SHEET PAPER DRYING CYLINDER FOR A CONTINUOUS PAPERMAKING MACHINE

[75] Inventors: Edgar J. Justus, Beloit, Wis.; Udino Stedile; Umberto Bollani, both of Torino, Italy

[73] Assignee: Beloit Corporation, Beloit, Wis.

[21] Appl. No.: 386,743

[22] Filed: Jun. 9, 1982

[30] Foreign Application Priority Data

Jun. 9, 1981 [IT] Italy ..... 67792 A/81

[51] Int. Cl.[3] ..... F26B 13/08

[52] U.S. Cl. ..... 34/119; 34/124; 34/125; 165/90

[58] Field of Search ..... 34/119, 124, 125; 165/90

[56] References Cited

U.S. PATENT DOCUMENTS

| | | | |
|---|---|---|---|
| 2,677,898 | 5/1954 | Ohlson et al. | 34/124 |
| 2,707,836 | 5/1955 | Garrett | 34/124 |
| 2,879,039 | 3/1959 | Skinner | 34/124 |
| 3,553,849 | 1/1971 | Carrier et al. | 34/124 |
| 4,069,594 | 1/1978 | Feurstein | 34/124 |
| 4,205,457 | 6/1980 | Sjostrand | 34/124 |
| 4,359,829 | 11/1982 | Schiel | 34/124 |

*Primary Examiner*—Larry I. Schwartz

*Attorney, Agent, or Firm*—Hill, Van Santen, Steadman & Simpson

[57] ABSTRACT

A steam heated cylindrical dryer drum for continuously drying a traveling paper web in a papermaking machine wherein steam is supplied to the inner cavity of the drum and the shell of the drum has a plurality of circumferential grooves with axially extending rectangular collectors and tubes projecting tangentially from the collectors of resiliently deflectable material biased outwardly toward the shell of the drum with positioning lugs on the free ends of the tubes resting on the ribs to fix their position in the base of the grooves.

10 Claims, 8 Drawing Figures

SHEET PAPER DRYING CYLINDER FOR A CONTINUOUS PAPERMAKING MACHINE

BACKGROUND OF THE INVENTION

The present invention relates to improvements in dryer drums for continuously drying a web of paper in a papermaking machine, and more particularly to an improved condensate removal structure.

In a papermaking machine a plurality of dryer drums are arranged in sequence for carrying a continuous web of paper in a serpentine fashion through the dryer section. The dryer drums are steam heated, and the drums are usually constructed of a cylindrical outer shell with a smooth outer surface for carrying the paper web with heads at the ends of the drum shell which are provided with supporting bearings for rotatably mounting the drum. Means are provided at the bearings for directing steam into the drum and as heat is transferred to the web supported on the surface of the shell, condensate tends to form which must be removed so that it will not have an insulating effect and reduce the heat transfer from the steam to the shell.

In a typical construction so that the heat transfer ability of the drum is increased, the shell is made as thin as possible, and for strength, a plurality of annular raised ribs are located on the inner surface of the shell with grooves therebetween. The condensate collects in these grooves, and it is imperative that it be effectively removed for increasing the efficiency of the dryer drum, and in high speed papermaking machines, it is imperative that heat transfer be maintained at maximum efficiency and that the insulating effect of condensate collected within the drum be maintained at a minimum and be immediately and effectively and uniformly removed.

In accordance with a provision of the present invention, there are provided a plurality of elongate tubes which suck the condensate from the base of the grooves and the tubes are uniquely constructed and supported for removal of the condensate.

In order to obtain good operation and a high coefficient of the transmission of heat to the paper web on the outer surface of the drum, it is advisable that the thickness of the condensates which accumulates in the bottom of the drum be maintained at a minimum, and it is also imperative that this thickness remain the same in all of the grooves to maintain the same coefficient of heat transmission over the whole length of the surface of the drum.

Presently known drums can be generally categorized in two types. One type has condensate collectors which are fixed to the inner surface of the shell, and the other type has condensate collectors which are fixed and supported to the central shaft of the drum. The first type insures the maintenance of the distance between the collector tubes within the drum and the bottom of the grooves, but has the disadvantage that with rotation of the drum, centrifugal forces generated by the mass of the collectors make the shell deform resiliently causing it to be polygonal because of the concentration of such forces at the location of the collectors.

Drums which have collectors that are supported on the central shaft have the disadvantage that there is no good control over the distance between the open ends of the collector tubes and the bottom of the grooves particularly because dimensions change with thermal deformation of the parts as temperatures change. There is thus a need for control over the depth or thickness of the condensate which rims at the bottom of the grooves. Another problem is encountered that small tubes cannot be mounted with a very small spacing between their open ends and the inner surfaces of the shell because contact can occur between the tubes and the bottom of the grooves in operation generating wear and stresses on the shell.

An object of the present invention is to provide a steam dryer drum and condensate removal structure which will avoid the aforementioned disadvantages.

A further object of the invention is to provide a condensate removal system utilizing individual tubes for the grooves wherein the tubes can be readily and accurately adjusted relative to the bottom of the groove for uniformity of spacing between the ends of the tubes and the groove.

A still further object of the invention is to provide a condensate removal system for a grooved or ribbed dryer drum wherein the radial spacing between the open receiving ends of condensate collector tubes and the bottom of the grooves remains constant independent of deformations of the shell during operation and independent of changes of dimensions due to thermal deformation.

In accordance with the principles of the invention, there is provided a rotary steam dryer drum for a continuous traveling web of paper wherein the drum is supplied with steam for drying the web and has a cylindrical shaped shell with a smooth outer surface and with heads at the end of the shell to support the drum in rotation. Within the shell on the inner surface are a plurality of ribs with circumferential grooves therebetween, and a plurality of axially extending collectors is supported and disposed within the interior of the drum to receive and take up the condensation resulting from the steam and to convey it out of the drum. The axially extending collectors are provided with a plurality of small elastically deflectable tubes which project in both circumferential directions from the collectors in such a way as to have the base end securely mounted on the collector for the flow of condensate from the tube to the collector and having the free end biased toward the bottom of the groove but provided with a lugged tube positioning element which rests on the inner surface of the ribs adjacent the grooves in order to maintain the free end a predetermined accurate controlled distance from the bottom of the groove.

Other objects, advantages and features will become more apparent with the teaching of the principles of the invention in connection with the disclosure of the preferred embodiments thereof in the specification, claims and drawings in which:

DESCRIPTION

Figure 1:
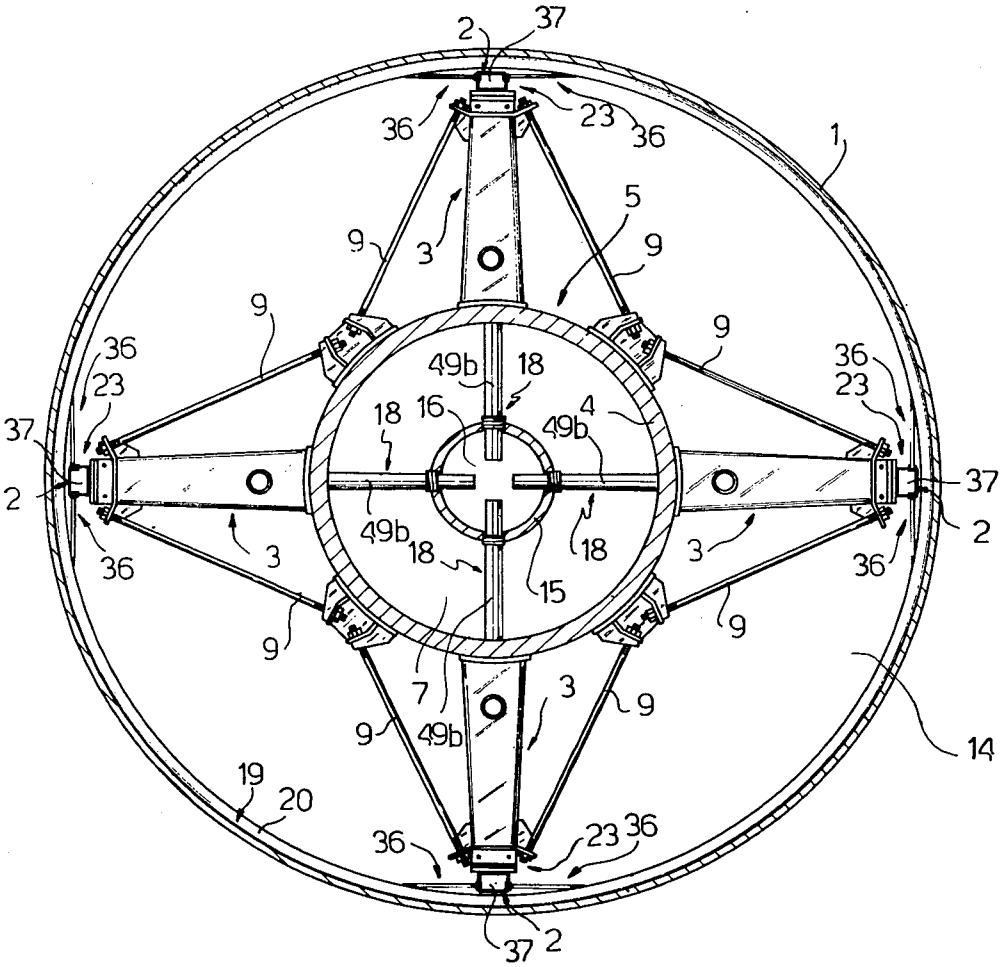
FIG. 1 is a sectional view on a plane perpendicular to the axis of rotation of the dryer drum.

The dryer drum incorporating the features of the present invention includes a cylindrical shell 1*a* having a smooth outer surface which supports the continuously traveling web of paper to be dried. The drum has at its ends heads 1 which with the shell define an inner cavity which receives steam and in which the other components of the device are housed. Within the shell are axially extending collectors 2 which extend parallel to the central rotational axis of the drum and which are of a slightly less length than the drum. The heads at the ends of the drum are provided with suitable support bearings, not shown, so that the drum can rotate during drying operation.

Each of the collectors 2 is held by means of four radial arms 3 which are supported at their inner ends on an annular wall 4 which is part of the central shaft 5 or hub of the drum. The hub is provided in the form of a hollow annular casting formed in sections and providing two cavities 6 and 7 which are separated from one another by a wall 8. Each of the radial arms 3 is also circumferentially supported by four pairs of struts or tie rods 9 which struts are fixed both to the hub and to the radial outer ends of the arms 3. The tie rods circumferentially support the arms, but also provide radial support and absorb part of the circumferential tension force created by the mass of the collectors which is subjected to centrifugal force during the rotation of the drum.

The central shaft, shown generally at 5, has an axial connection for the delivery of steam into the interior, and the hub 4 has a plurality of radial holes 13 which permit the steam to flow into the cavity 14 to come in contact with the shell. Within the hub 4 is constructed a cylindrical wall 15 which defines a cavity 16 for the receipt and transmittal of condensate which flows axially outwardly through the end of the drum through an outlet hole 17.

Each collector 2 is in communication with the condensate cavity 16 by means of its own tube 18 in such a manner that under a given pressure differential or suction created by a pump or suitable suction device outside the drum, a flow of condensate will be caused from the collectors 2 into the cavity 16 and outwardly of the drum.

Figure 2:
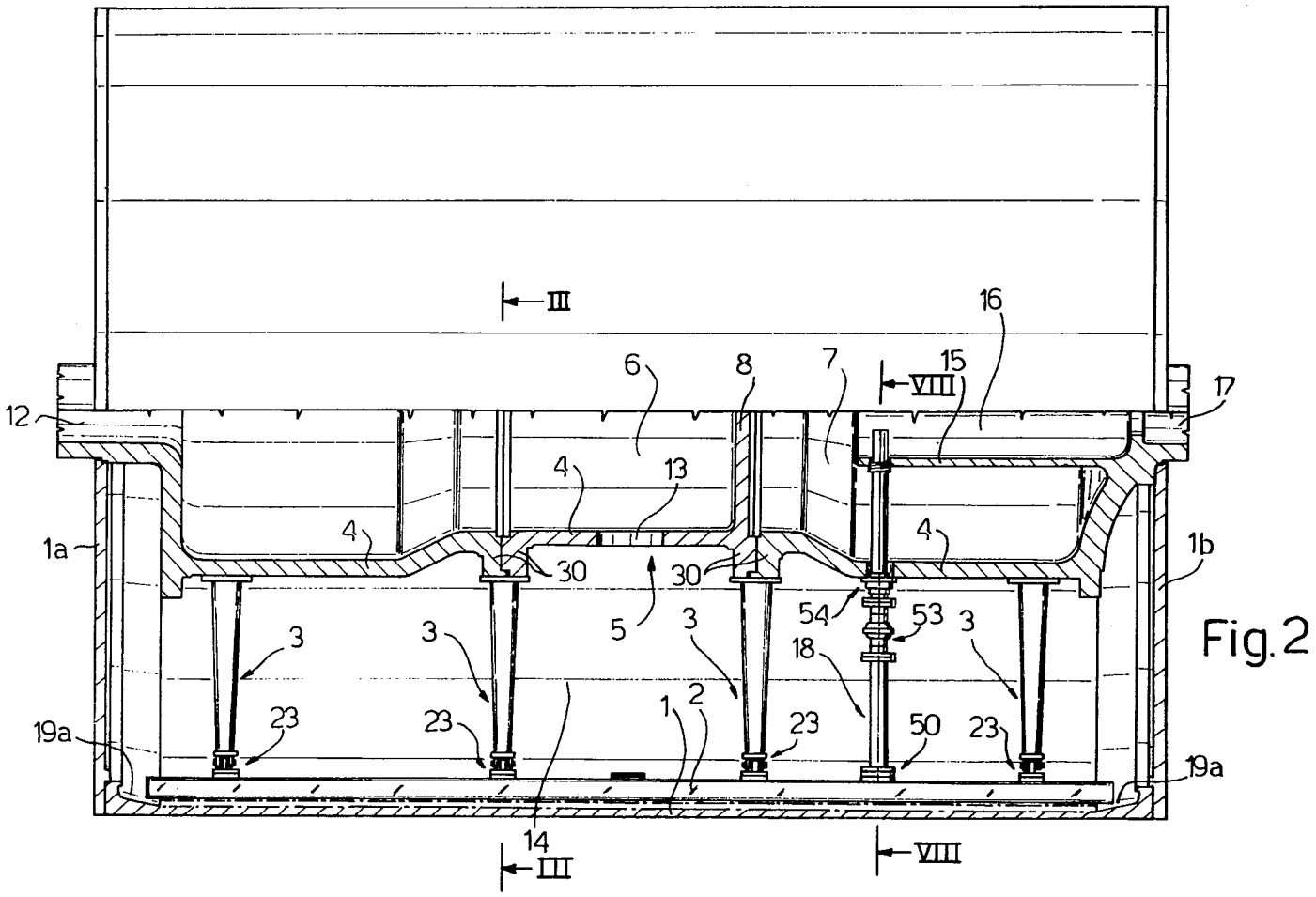
FIG. 2 is a partial sectional view taken on a plane extending parallel to the drum axis.
Figure 3:
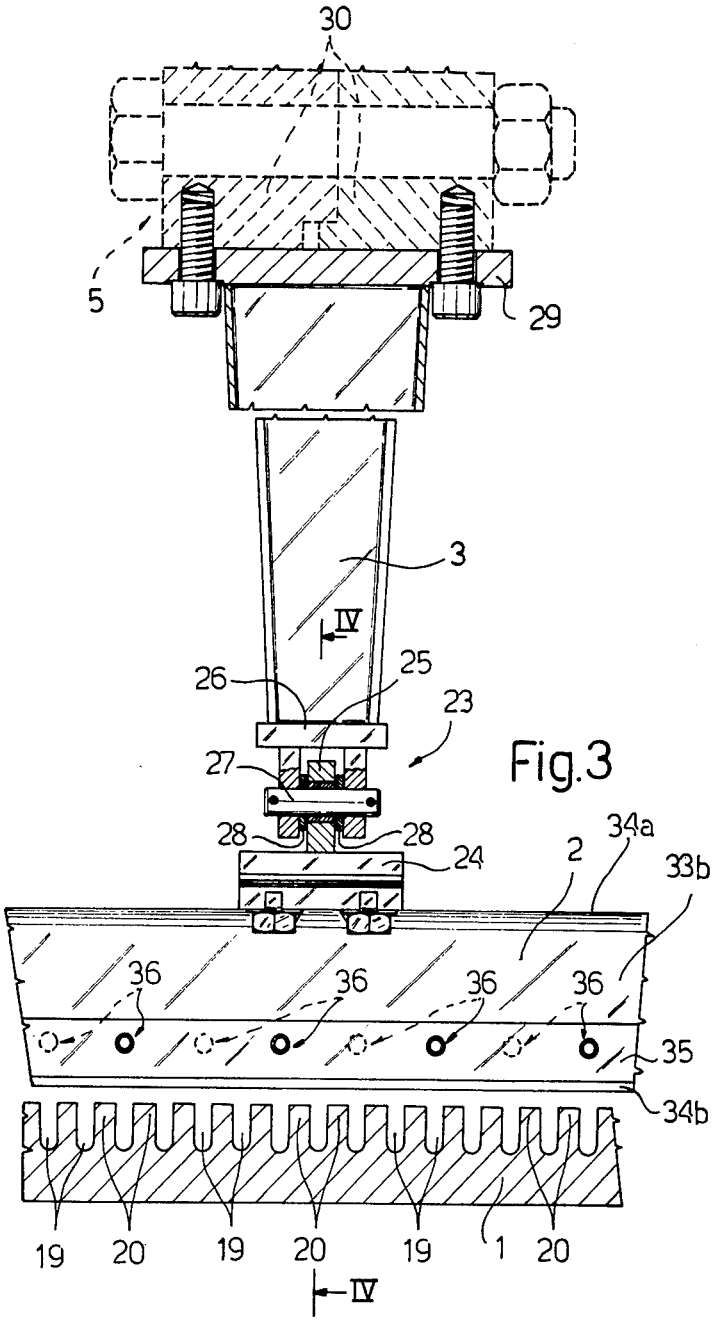
FIG. 3 is a sectional view taken substantially along line III—III of FIG. 2.

As is shown in FIGS. 1, 2 and 3, the outer surface of the shell 1 is smooth and cylindrical in shape for providing support for the paper web and for good heat transmission. The inner surface of the shell is circumferentially grooved to increase the area for heat exchange, to reduce the distance to the outer surface of the shell, to strengthen the shell, and to create a series of collection channels for condensate which forms during operation. The grooves are formed by integral ribs on the inner surface of the shell, and the grooves are shown at 19 separated by the ribs 20.

The axially extending collectors 3 are positioned closely adjacent the shell and supported by arms 3 with the connection between the collector and its supporting arms provided by means shown at 23 (FIG. 3). This includes a plate 24 provided with a lug 25 fixed to the collector, and a fork 26 fixed to the radially outermost end of the arm 2 and receiving the lug 25. A pair of pins 27 (FIG. 4) pivotally fix the lub to the fork 26. Between the sides of the fork, there is a spacer washer 28 of a thickness so as to allow axial play of the collector 2 by allowing small displacements of the lug 25 as axial expansion and contraction of the collection occurs due to temperature variations.

In the arrangement illustrated in FIG. 3, each arm 3 is hollow, and its radially innermost end is fixed and supported by means of a flange 29 to flange parts 30 of the central shaft 5.

Figures 4, 5, 6, 7:
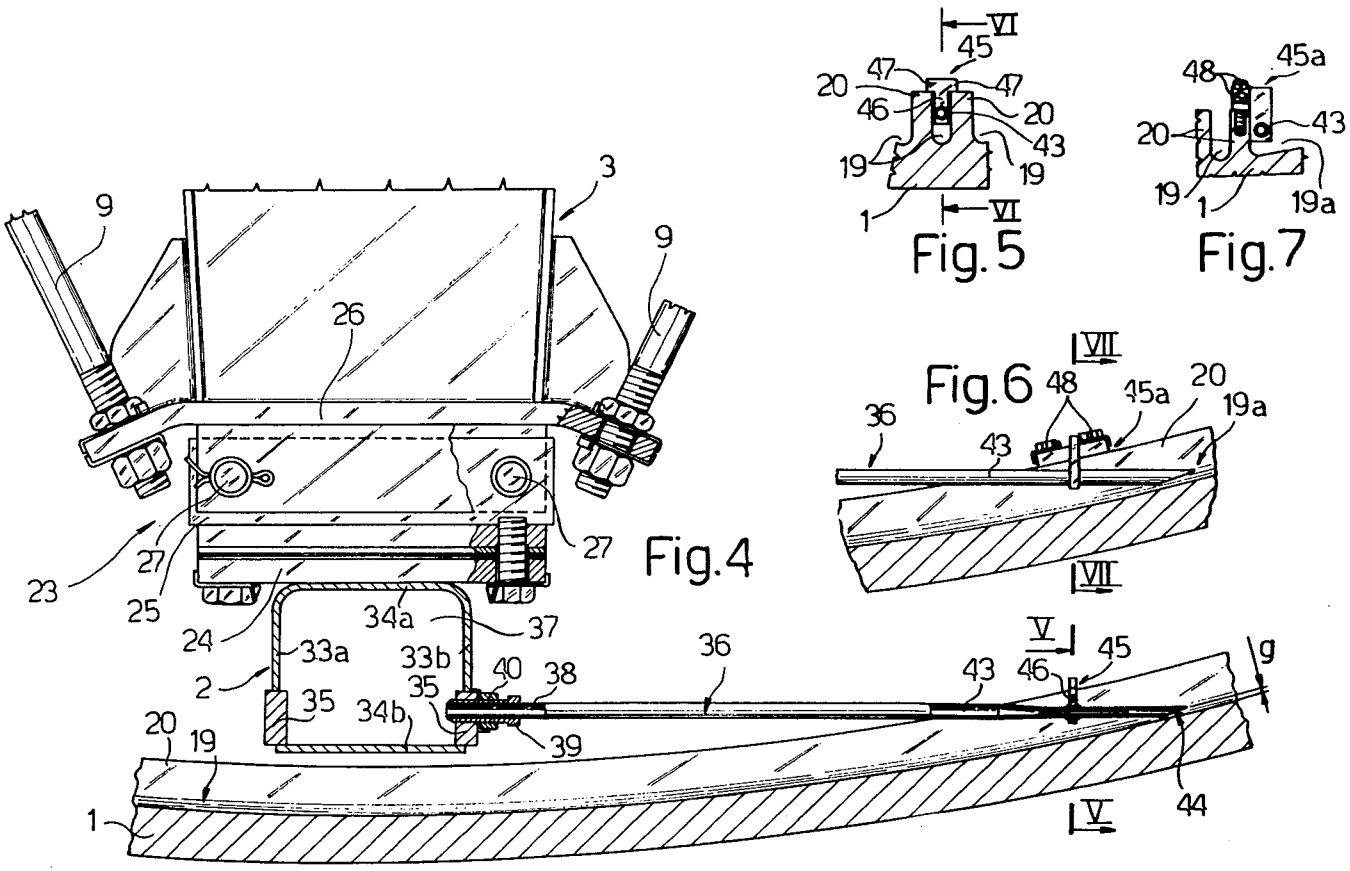
FIG. 4 is a partial sectional view taken substantially along line IV—IV of FIG. 3.
FIG. 5 is as fragmentary detailed sectional view taken substantially along line V—V of FIG. 4.
FIG. 6 is a fragmentary detailed sectional view taken substantially along line VI—VI of FIG. 5.
FIG. 7 is a fragmentary detailed sectional view taken substantially along line VII—VII of FIG. 6 and showing a modified form of support.

As shown in FIG. 4, each collector 2 has a substantially rectangular section with flat walls 33*a*, 33*b*. The upper wall 33*a* is fixed to the plate 24 of connection means while the lower plate 34*b* is located a short distance inwardly from the ribs 20. As shown in FIG. 4, the wall 34*a* and parts of the walls 33*a* and 33*b* are constructed from a shaped integral section of sheet metal, and the other parts of the walls are provided by bars 35 having a greater thickness than that of the wall as illustrated in the sectional view of FIG. 4. These bars provide a rigid base for supporting tubes 36.

From the walls 33*a* and 33*b* of each collector 2, small tubes 36 extend in a substantial tangential direction with respect to the shell 1. These tubes lead from each of the grooves to the interior of the collector 2. The base or support end 38 of each of the tubes passes through one of the walls 33*a* and 33*b* of the associated collector and is inserted into a bushing 39, the threaded outer surface of which is screwed into a corresponding threaded hole formed in the bar 35 of the associated wall 33*a*, 33*b*. A ring nut 40 locks this bushing and the associated small tube to the wall. The outer free end of each of the tubes 36 projects into a radial groove 19 as illustrated in FIG. 4. The tube is shaped so that it diminishes in diameter from the base end 38 toward the free end. The free end is cut at a bias so as to be parallel to the inner surface of the base of the groove, and therefore suction flow of the condensate into the tube is enhanced.

Each of the tubes 36 is made from an elastically deflectable material which is resistant to the temperature of the steam within the cylinder. Preferably, the tubes are formed of metal, and the tubes in effect are a cantilever elastic beam supported on the associated collector with a natural bias or bend so as to cause the free end to spring toward the base of the groove.

At the free end of each tube is secured a small guide plate 45 (FIGS. 4 and 5) preferably having a substantially T-shaped form. This guide plate is a tube positioning element and has a central lug 46 with a hole therethrough into which projects the tube. The lug is sufficiently narrow so that it fits within the groove. The lug has at least one, but preferably, a pair of laterally extending arms 47 which rest on the top of the adjacent ribs 20. In this way, the free open end 44 of each tube is held a predetermined very small distance from the bottom surface 19 of the groove as indicated at g in FIGS. 4 and 6.

While other forms of bias may be used, it is preferred that the tube be constructed of a resilient material so that it can be mounted at its base to be biased along its length to urge its free end toward the base of the groove. The bias is such that a preload or stress exists in the tube which is counteracted by the tube positioning element 45.

The element rests on the top of the ridges and the ridges' top surface is parallel to the base of the grooves so that essentially with expansion or contraction due to temperature difference, the element 45 can slide on the rib without binding.

In the end regions of the heads, there is a formed a radial groove 19*a* (FIG. 2) of axial width greater than the grooves. In this groove 19*a* there is inserted a tube 36, the free end of which is rigidly positioned with respect to the bottom of this groove by a plate 45*a* (FIG. 6) fixed to the rib 20 adjacent the groove, such as by screws 48. The plate 45*a* has a hole to receive the tube 43 and allow a limited amount of radial play.

Figure 8:
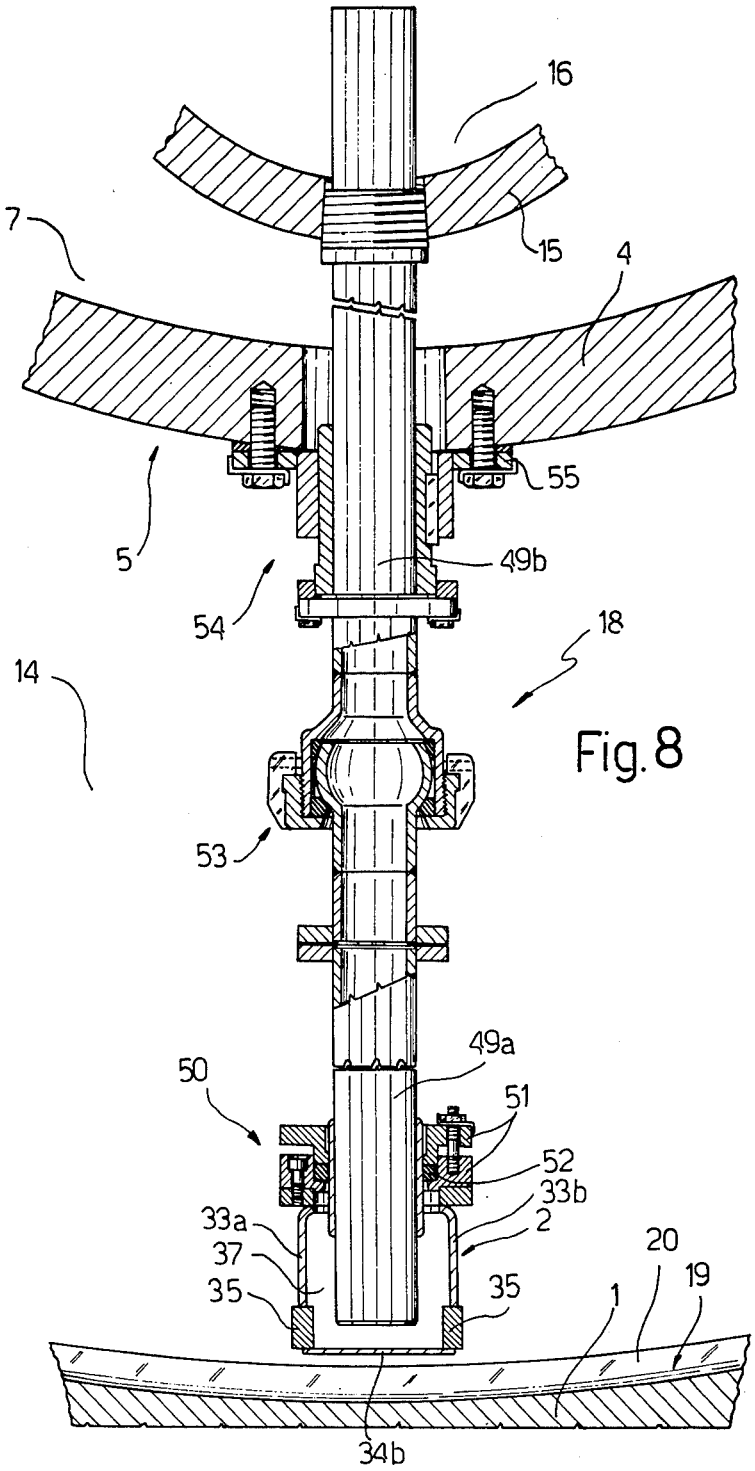
FIG. 8 is a detailed view, partly in section, taken substantially along line VIII—VIII of FIG. 2.

Each discharge tube 18 (FIGS. 1 and 2) for the discharge of condensate from each collector 2 has a structure such as shown in FIG. 8 and includes a first section 49*a* fitted into the collector itself by means of a sealing assembly 50. This includes a pair of flanges 51 and a sealing element 52. Also included is a second section 49*b* passing through the wall 15 and connected to the preceeding part by means of a ball joint 53 of a known type. The discharge tube 18 is guided and maintained in position along the shaft 5 by means of a bushing assembly 54 provided with a flange 55 connected to the wall 4 of the shaft.

Any configuration of tubes 36 projecting from each collector 2 can be employed. Preferably, the tubes are constructed to project alternately in opposite circumferential directions with respect to the supporting collector, but different arrangements can be adopted.

In operation steam is supplied to the interior of the drum through the cavity 14 through the hole 12, the cavity 6 and the radial holes 13 for heating the shell. As heat is extracted from the steam for evaporating water from the paper sheet, this causes condensation within the drum which collects at the bottom of the grooves 19 (FIG. 3). Through the holes 17 and the cavity 16 a suction is applied which creates a lowered pressure within the interior of the collectors 2. The condensate, or a mixture of condensate and steam is drawn through the small tubes 36 through the free open ends 43 having their collection surfaces 44 in close proximity to the base of the grooves. It is, therefore, apparent that a spacing g between the surfaces 44 and the base is very small, and the condensate can almost completely be sucked up with the intended advantage of increasing the coefficient of heat transfer between the steam and the metal of the shell.

During operation of the device, the shell of one of the cylinders is subjected to deformations produced by thermal expansion due to the heat within the drum and the removal of heat by the water evaporating from the web on the outer surface of the drum and these circumstances will vary during operation. As a consequence of this deformation of the shell, the substantially cylindrical form of the shell and its associated grooves 19 varies. Such a variation in form does not have any negative effect on the sucking action exerted on the condensate in the bottom of the grooves 19 by the tubes. In fact, whatever the dimensional and form variations of the groove, the clearance space g between the surface 44 of a given tube in the bottom surface of the associated groove is maintained constant. This favorable result is obtained because the free end of the tube is positioned in a fixed manner with respect to the bottom of the groove both by the action of the plate 45 and by the resilient preloading of the tube. Whatever the displacement of the bottom surface of the groove which is located beneath the end surface 44 of the tube, the same displacement occurs on the ribs on either side of the groove. Because of the abutment on the plate 45 on these ribs, this causes a corresponding displacement of the end of the tube.

The condensate drawn up into the various collectors is conveyed through the discharge tubes 18, the cavity 16 and the hole 17 out of the drum.

Because of the form of the section of each collector which is rectangular, it can be arranged in a radial position very close to the inner surfaces of the shell with the advantage of improving effectiveness of the suction.

Each tube 36 can be accurately positioned with respect to the associated collector by means of the bushing and ring 39 and ring nut 40 for the purpose of positioning in a correct manner the end 44 of the tube with respect to the bottom surface of the associated groove 19.

While the preferred form is illustrated, it will be apparent from the foregoing teaching of the description that various parts of the embodiment of the present invention can be varied without departing from the spirit and scope of the invention.

We claim as our invention:

1. A steam heated cylindrical dryer drum for continuously drying a traveling paper web in a papermaking machine comprising in combination:

a rotary mounted cylindrical dryer drum having an outer shell with a smooth outer surface with heads at the ends defining a steam containing cavity within;

annular ribs on the inner surface of the shell defining axially spaced grooves in which condensate collects during drying operation as heat is transferred to a web on the drum surface;

a plurality of elongate collector tubes within the drum each having a supporting base end and having a condensate collection free end projecting into a groove and extending in a generally tangential direction being formed of an elastically deflectable material;

a condensate collector rigidly supporting the base end of the tubes with the tubes biased toward the shell so that said free ends tend to move toward the shell;

and a tube positioning element secured to the tube at the free end in supporting engagement with the inner surface of the shell adjacent the grooves fixedly positioning the free end a predetermined distance from the bottom of the groove.

2. A steam heated cylindrical dryer drum for continuously drying a traveling paper web in a papermaking machine constructed in accordance with claim 1:

wherein said tube is secured to the collector with a preload bias in such a manner that the free end of the tube exerts a predetermined force toward the shell.

3. A steam heated cylindrical dryer drum for continuously drying a traveling paper web in a papermaking machine constructed in accordance with claim 1:

wherein said tube positioning element comprises a small plate provided with an opening into which the free end of the tube is inserted and includes a lug engaging the inner surface of the shell.

4. A steam heated cylindrical dryer drum for continuously drying a traveling paper web in a papermaking machine constructed in accordance with claim 1:

wherein the shell has a surface which is engaged by the tube positioning element which surface is substantially parallel to the bottom surface of the groove.

5. A steam heated cylindrical dryer drum for continuously drying a traveling paper web in a papermaking machine constructed in accordance with claim 1:

wherein said condensate collector extends axially and is rectangular in shape with tubes projecting circumferentially from opposite walls of said collector.

6. A steam heated cylindrical dryer drum for continuously drying a traveling paper web in a papermaking machine constructed in accordance with claim 5:

wherein each of the tubes includes an adjustment means for adjusting the axial position of the tube relative to the collector.

7. A steam heated cylindrical dryer drum for continuously drying a traveling paper web in a papermaking machine comprising in combination:

a rotary mounted cylindrical dryer drum having an outer shell with a smooth outer surface with heads at the ends defining a steam containing cavity within;

a plurality of collectors having open condensate receiving ends adjacent the inner surface of the drum;

means biasing the collectors radially toward the drum; means resisting said bias and limiting the movement of the collectors to limit the position of the free ends of the collectors to be a predetermined distance from the inner surface of the drum;

and said drum having a plurality of radial ribs on the inner surface of said shell defining grooves therebetween, said collectors being in the form of elongate tubes having free ends projecting into the grooves and extending in a generally tangential direction, said movement limiting means being in the form of a lug secured to the tube and resting on the radial inner surface of the rib.

8. A steam heated cylindrical dryer drum for continuously drying a traveling paper web in a papermaking machine constructed in accordance with claim 7:

wherein said lug has an adjustment device forcing it radially inwardly to position the free end of the tube.

9. A steam heated cylindrical dryer drum for continuously drying a traveling paper web in a papermaking machine constructed in accordance with claim 8:

wherein said lug is T-shaped with ends resting on adjacent ribs.

10. A steam heated cylindrical dryer drum for continuously drying a traveling paper web in a papermaking machine constructed in accordance with claim 7:

wherein the tubes are mounted on their base ends to axially extending collectors;

radially extending arms mounted on a hub within the drum supporting the collectors at the ends;

and angular struts connected between said hub and the outer ends of said arms providing radial and circumferential support for the arms.

* * * * *